US007740310B1

(12) United States Patent
Forster

(10) Patent No.: US 7,740,310 B1
(45) Date of Patent: Jun. 22, 2010

(54) LAWN CHAIR WITH INCORPORATED SOLAR LIGHT PROTECTIVE DEVICE

(76) Inventor: Elizabeth M. Forster, 2461 Trailard Dr., Willoughby Hills, OH (US) 44094

( * ) Notice: Subject to any disclaimer, the term of this patent is extended or adjusted under 35 U.S.C. 154(b) by 0 days.

(21) Appl. No.: 12/145,048

(22) Filed: Jun. 24, 2008

(51) Int. Cl.
*A47C 7/62* (2006.01)
*A47C 4/28* (2006.01)

(52) U.S. Cl. ..... 297/184.15; 297/184.1; 297/184.11; 297/31; 135/96

(58) Field of Classification Search ..... 297/31, 297/184.1, 184.11, 184.15, 184.14; 135/96
See application file for complete search history.

(56) References Cited

U.S. PATENT DOCUMENTS

| | | | | | |
|---|---|---|---|---|---|
| 678,957 | A | | 7/1901 | Kelly | |
| 2,266,853 | A | | 12/1941 | Dabney | |
| 3,918,109 | A | * | 11/1975 | Barraclough | 5/113 |
| 4,201,416 | A | * | 5/1980 | Vanderminden | 297/184.15 |
| 4,924,896 | A | * | 5/1990 | Carter | 135/90 |
| 4,930,534 | A | | 6/1990 | Hill | |
| D312,931 | S | | 12/1990 | Westfall et al. | |
| 5,096,257 | A | * | 3/1992 | Clark | 297/184.15 |
| 5,320,405 | A | | 6/1994 | Foster et al. | |
| 5,395,157 | A | * | 3/1995 | Rollo et al. | 297/344.26 |
| 5,551,745 | A | * | 9/1996 | Huang | 296/111 |
| 5,752,537 | A | | 5/1998 | Kranzler | |
| 5,833,310 | A | * | 11/1998 | Labelle | 297/184.1 |
| 5,944,384 | A | * | 8/1999 | Patterson | 297/344.23 |
| 5,967,601 | A | * | 10/1999 | Gillins | 297/184.15 |
| 6,095,172 | A | * | 8/2000 | Trapp et al. | 135/96 |
| 6,478,038 | B1 | | 11/2002 | Le Gette et al. | |
| 7,118,172 | B1 | * | 10/2006 | Pattison-Sheets | 297/129 |
| 7,431,388 | B2 | * | 10/2008 | Sharapov | 297/184.11 |

* cited by examiner

*Primary Examiner*—David Dunn
*Assistant Examiner*—Erika Garrett
(74) *Attorney, Agent, or Firm*—Crossley Patent Law; Mark A. Crossley

(57) ABSTRACT

A lawn chair with an incorporated solar light protective device that is designed to provide an outdoor place to sit down, while at the same time, provide a place to hide an individual from the potentially damaging rays of the sun. The device includes a sheet of flexible material, preferably canvas, that is mounted above a lawn chair. Some aspects of the sheet are adjustable to allow to be adjusted as needed for various users. The sheet is preferably placed over the head end of the lawn chair, protecting an individual's upper body while the individual is lying in the lawn chair.

4 Claims, 7 Drawing Sheets

LAWN CHAIR WITH INCORPORATED SOLAR LIGHT PROTECTIVE DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The present invention concerns that of a new and improved lawn chair with an incorporated solar light protective device that is designed to provide an outdoor place to sit down, while at the same time, provide a place to hide an individual from the potentially damaging rays of the sun.

SUMMARY OF THE INVENTION

The present invention concerns that of a new and improved lawn chair with an incorporated solar light protective device that is designed to provide an outdoor place to sit down, while at the same time, provide a place to hide an individual from the potentially damaging rays of the sun. The device includes a sheet of flexible material, preferably canvas, that is mounted above a lawn chair. Some aspects of the sheet are adjustable to allow to be adjusted as needed for various users. The sheet is preferably placed over the head end of the lawn chair, protecting an individual's upper body while the individual is lying in the lawn chair.

There has thus been outlined, rather broadly, the more important features of a lawn chair with an incorporated solar light protective device that the detailed description thereof that follows may be better understood and in order that the present contribution to the art may be better appreciated. There are, of course, additional features of the lawn chair with an incorporated solar light protective device that will be described hereinafter and which will form the subject matter of the claims appended hereto.

In this respect, before explaining at least one embodiment of the lawn chair with an incorporated solar light protective device in detail, it is to be understood that the lawn chair with an incorporated solar light protective device is not limited in its application to the details of construction and to the arrangements of the components set forth in the following description or illustrated in the drawings. The lawn chair with an incorporated solar light protective device is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present lawn chair with an incorporated solar light protective device. It is important, therefore, that the claims be regarded as including such equivalent constructions insofar as they do not depart from the spirit and scope of the present invention.

It is therefore an object of the present invention to provide a lawn chair with an incorporated solar light protective device which has all of the advantages of the prior art and none of the disadvantages.

It is another object of the present invention to provide a lawn chair with an incorporated solar light protective device which may be easily and efficiently manufactured and marketed.

It is another object of the present invention to provide a lawn chair with an incorporated solar light protective device which is of durable and reliable construction.

It is yet another object of the present invention to provide a lawn chair with an incorporated solar light protective device which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
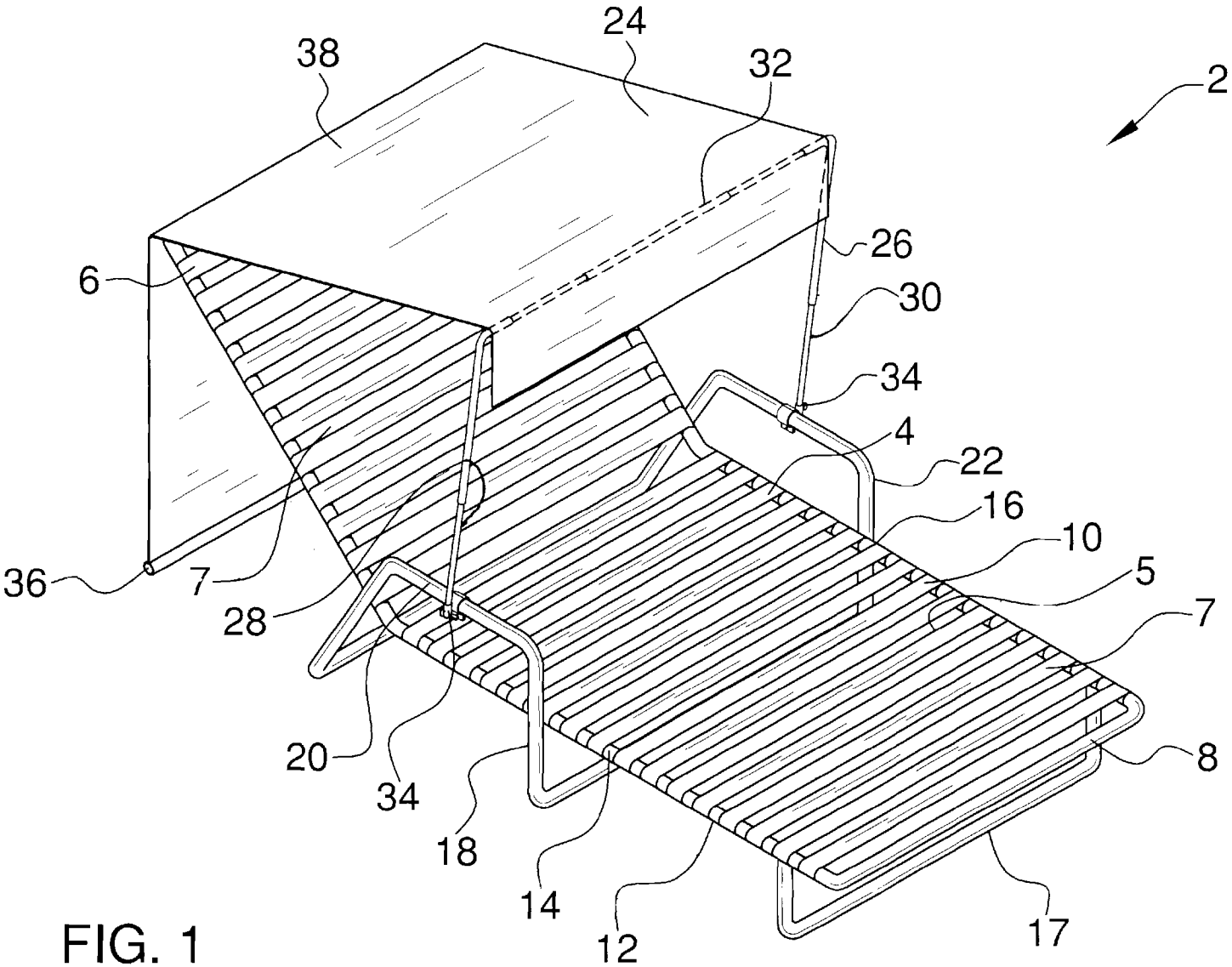
FIG. 1 shows a perspective view of the lawn chair with an incorporated solar light protective device.
Figure 2:
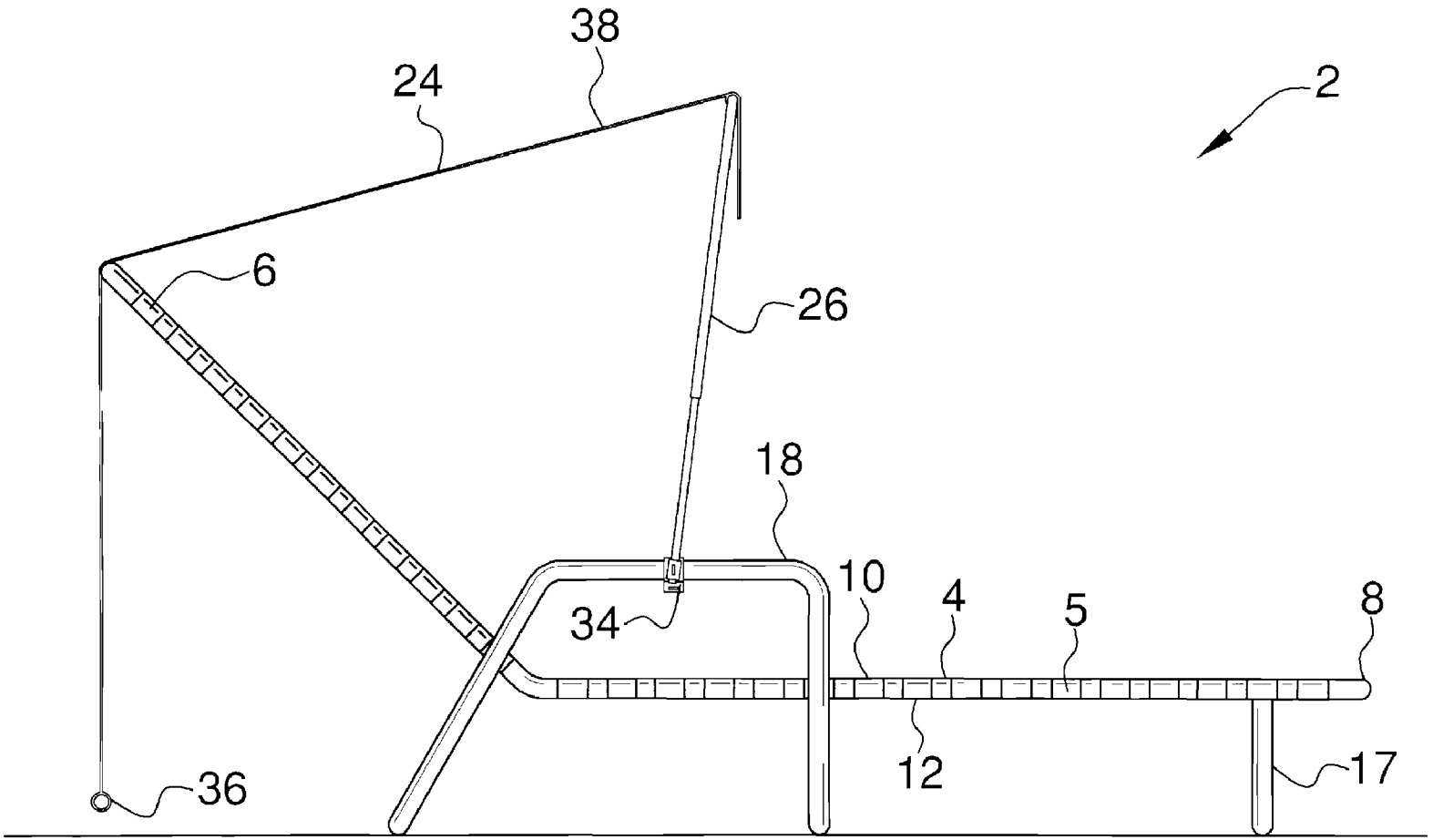
FIG. 2 shows a perspective view of the lawn chair with an incorporated solar light protective device.
Figure 3:
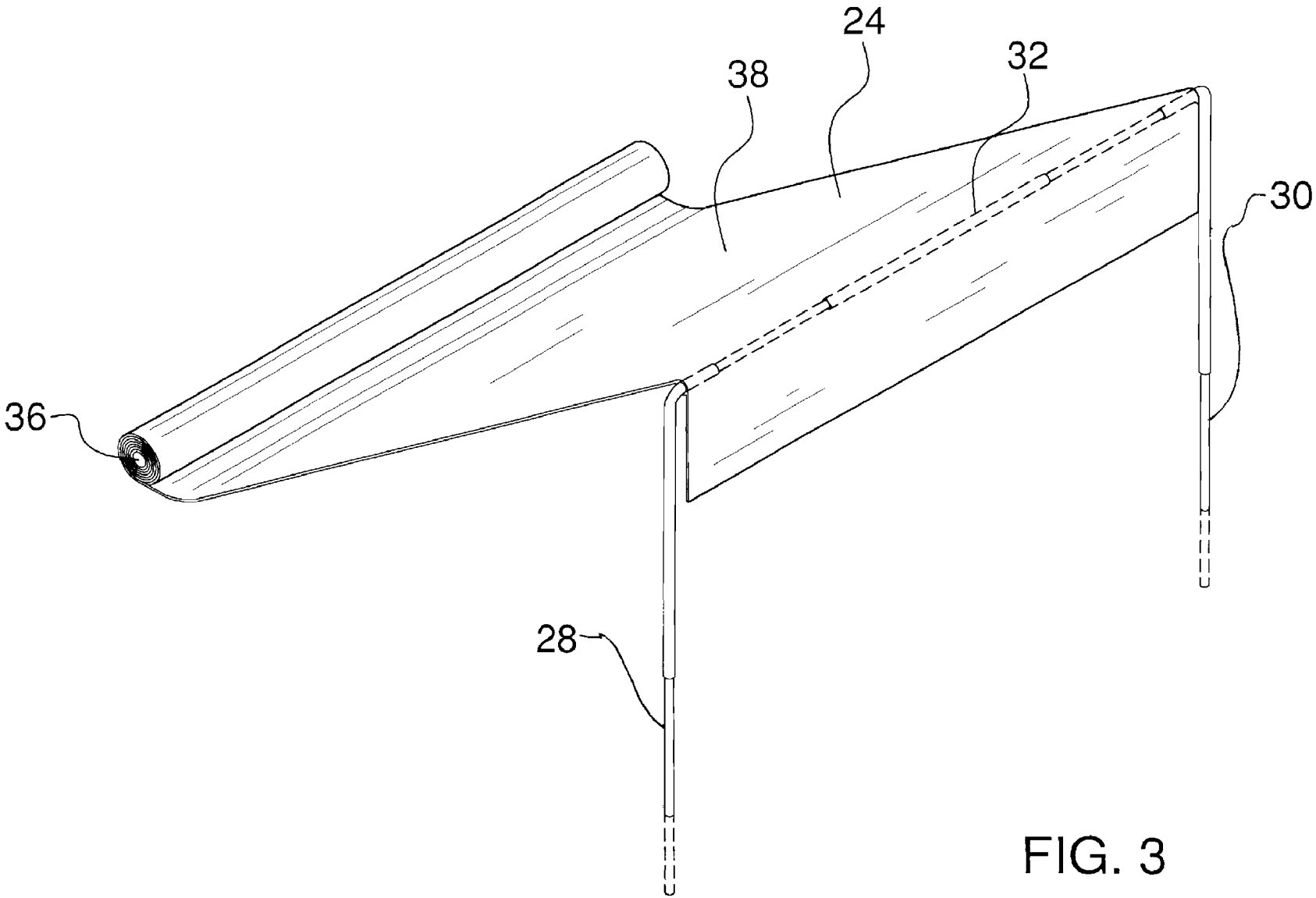
FIG. 3 shows a perspective view of the solar light protective device that is associated with the lawn chair.
Figure 4:
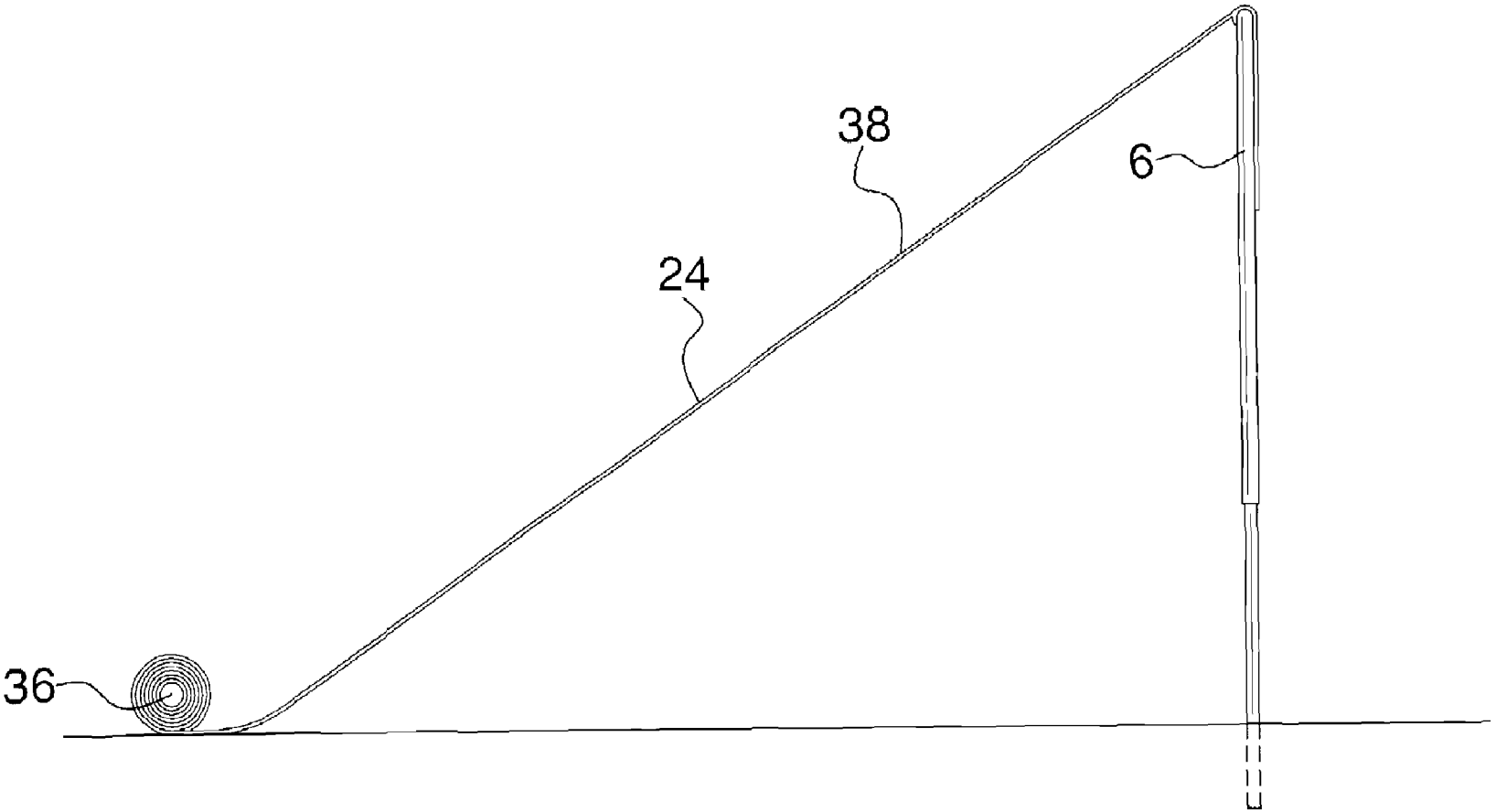
FIG. 4 shows a side view of the flexible sheet associated with the solar light protective device and the means for mounting the flexible sheet.
Figure 5:
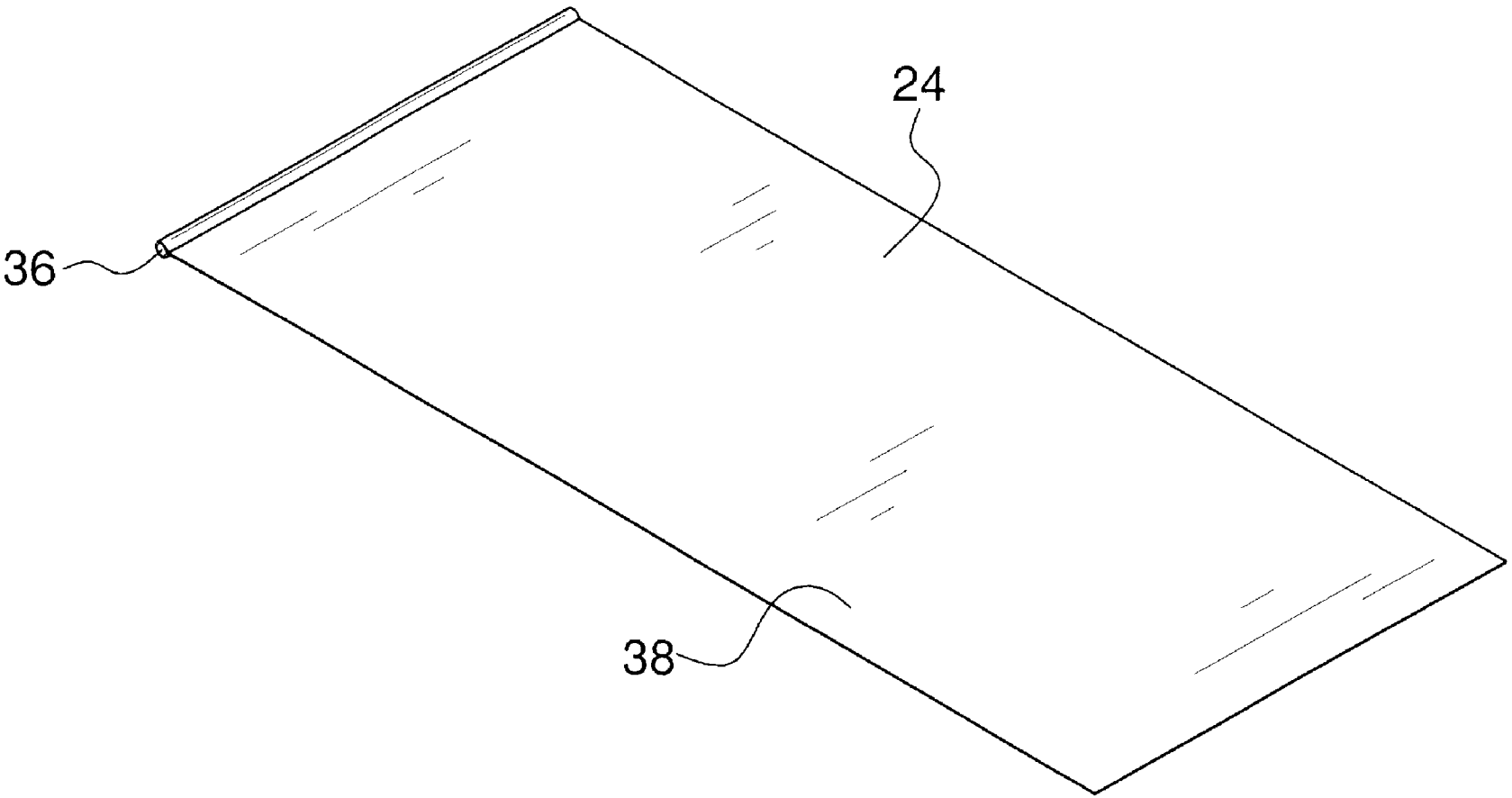
FIG. 5 shows a perspective view of the flexible sheet associated with the solar light protective device laid out in flat form.
Figure 6:
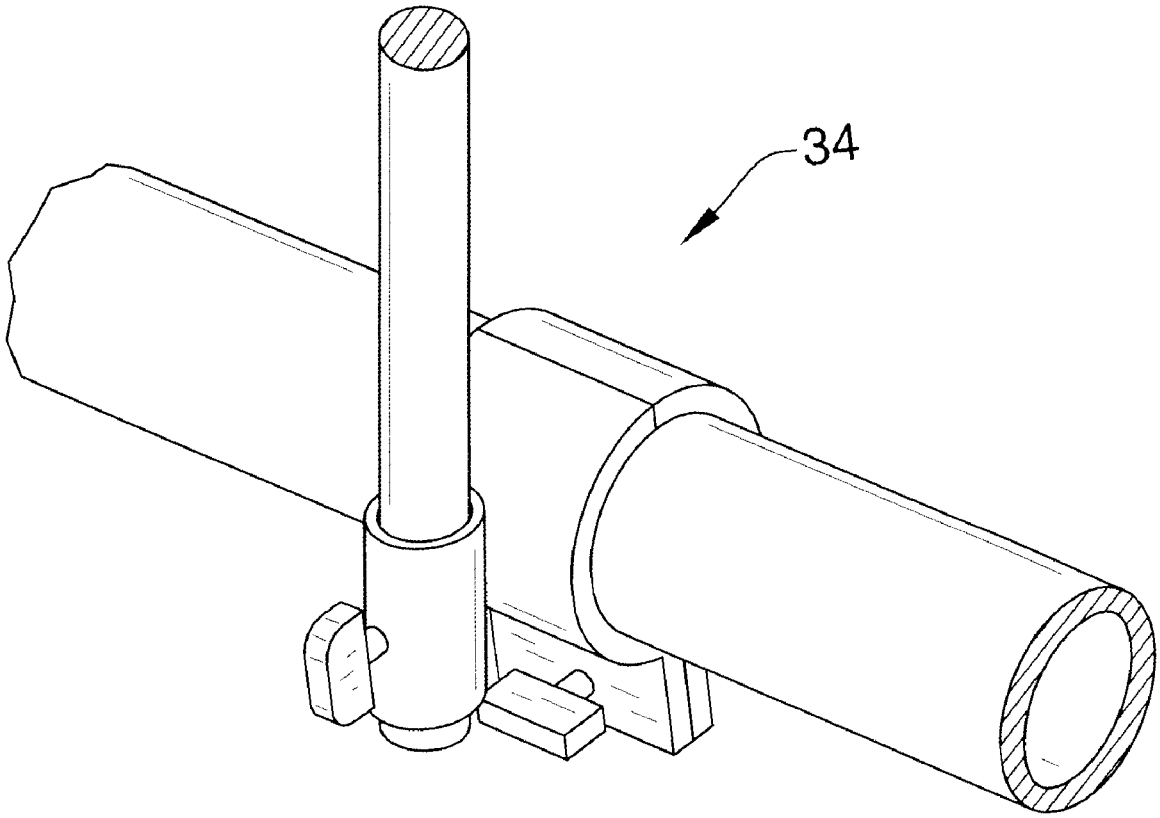
FIG. 6 shows a close-up perspective view of a support leg of the support stand that mounts the flexible sheet associated with the solar light protective device in an upright position.
Figure 7:
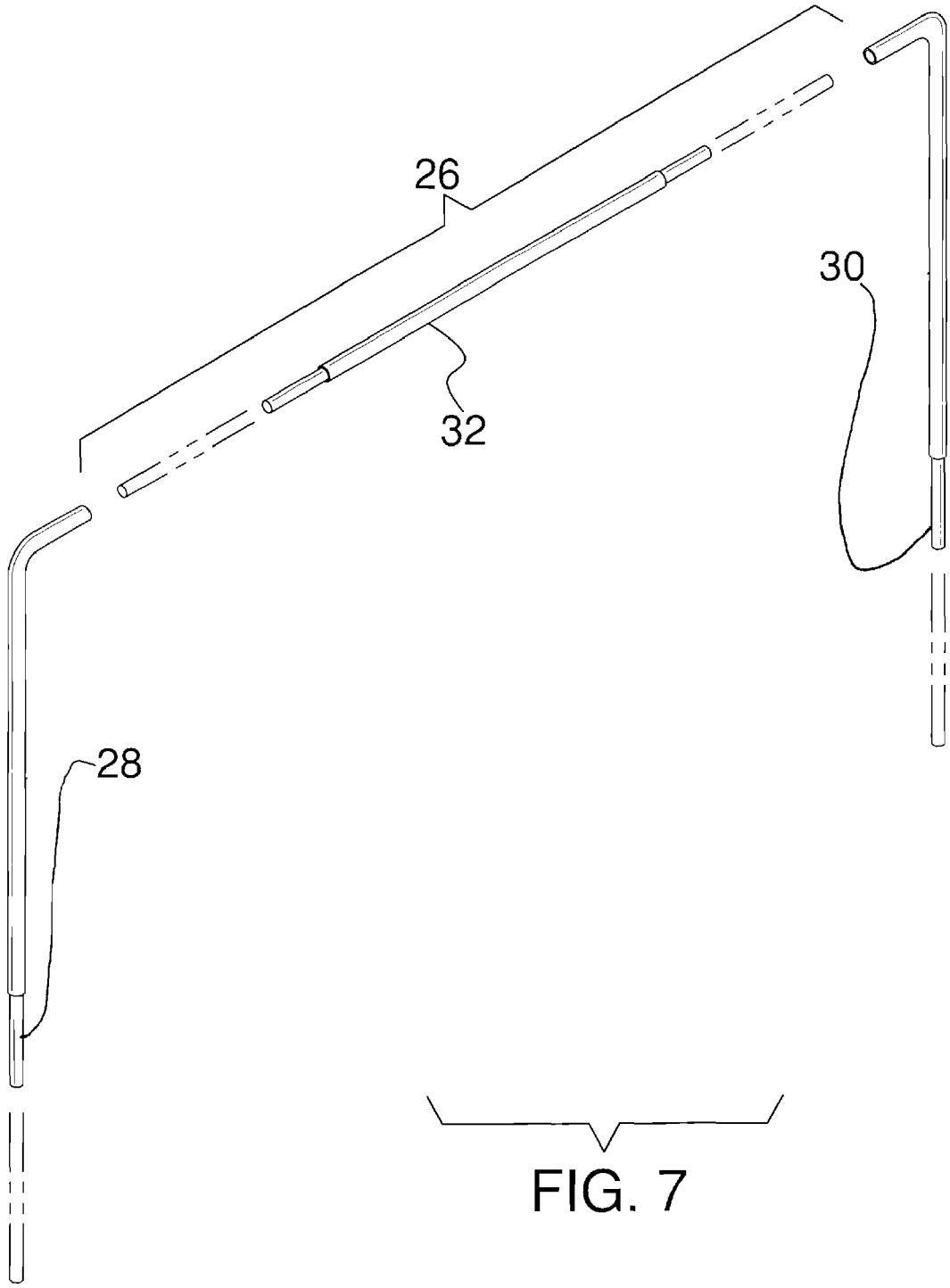
FIG. 7 shows a perspective view of the support stand associated with the solar light protective device.

With reference now to the drawings, and in particular to FIGS. 1 through 7 thereof, a lawn chair with an incorporated solar light protective device embodying the principles and concepts of the present invention and generally designated by the reference numeral 2 will be described.

As best illustrated in FIGS. 1 through 7, the lawn chair with an incorporated solar light protective device 2 comprises a lawn chair 4, with the lawn chair preferably having two ends comprising a head end 6 and a foot end 8. The lawn chair 4 also preferably has two surfaces comprising an upper surface 10 and a lower surface 12 and also two side surfaces comprising a first side surface 14 and a second side surface 16.

The lawn chair 4 itself comprises an outer, hollow frame 5 that is interwoven with a plurality of flexible strips 7 that are connected to the frame 5. The head end 6 of the lawn chair 4 is pivotally attached to the foot end 8 of the lawn chair 4. The lawn chair 4 may sit atop sand 90 as shown in FIG. 1.

The lawn chair 4 includes a central support structure 18 that is attached to the lawn chair approximately halfway in between the head end 6 and the foot end 8 of the lawn chair 4, with the central support structure 18 including a pair of handles comprising a first handle 20 and a second handle 22. The first handle 20 is associated with the first side surface 14, while the second handle 22 is associated with the second side surface 16. The lawn chair 4 is also supported by a foot stand 17 that is attached to the lower surface 12 of the lawn chair 4, with the foot stand 17 being located near the foot end 8 of the lawn chair 4.

A flexible sheet 24, having two ends comprising a first end and a second end, is positioned over the head end 6 of the lawn chair 4 and is mounted by a U-shaped support frame 26. The first end of the flexible sheet 24 is draped over the support frame 26. The support frame 26 includes a pair of support legs comprising a first support leg 28 and a second support leg 30, with the first support leg 28 being attached to the first handle 20 and the second support leg 30 being attached to the second handle 22. A central support rod 32 connects the first support leg 28 to the second support leg 30.

Each of the two support legs 28 and 30 are adjustable in height. Furthermore, each of the support legs 28 and 30 are attached to their respective handles 20 and 22 by an associated swivel clamp 34.

The flexible sheet 24 is placed over the head end 6 of the lawn chair 4, with the second end of the flexible sheet 24 being cylindrically rolled around a pipe 36. The pipe 36 is left to hang about one to two feet below the head end 6 of the lawn chair 4, thereby serving to keep the flexible sheet 24 in placed over the top of the head end 6 of the lawn chair 4. The flexible sheet 24 can be manufactured from a wide variety of materials, but preferably, is manufactured from canvas 38.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim as my invention is:

1. A lawn chair with an incorporated solar light protective device comprising a lawn chair, the lawn chair having two ends comprising a head end and a foot end, the lawn chair being fabricated from a hollow frame, the lawn chair further comprising two surfaces comprising an upper surface and a lower surface, the lawn chair further comprising two side surfaces comprising a first side surface and a second side surface, means for providing flexibility on the lawn chair, means for supporting the lawn chair, a flexible sheet, the flexible sheet having two ends comprising a first end and a second end, means for mounting the flexible sheet to the lawn chair, wherein the means for providing flexibility on the lawn chair further comprises a plurality of flexible strips, wherein each of the flexible strips of the plurality of flexible strips are connected to the hollow frame, wherein the means for supporting the lawn chair further comprises a foot stand attached to the lower surface of the lawn chair near the foot end of the lawn chair, and a central support structure attached to the lawn chair approximately halfway in between the head end of the lawn chair and the foot end of the lawn chair, wherein the central support structure further comprises a pair of handles comprising a first handle and a second handle, wherein the first handle is associated with the first side surface of the lawn chair, further wherein the second handle is associated with the second side surface of the lawn chair, wherein the means for mounting the flexible sheet to the lawn chair further comprises a support frame, the support frame further comprising a pair of support legs comprising a first support leg and a second support leg, wherein the first support leg is associated with the first handle, further wherein the second support leg is associated with the second handle, a central support rod, wherein the central support rod connects the first support leg to the second support leg, means for attaching each support leg to its associated handle, means for maintaining the flexible sheet in place over the top of the head end of the lawn chair, wherein the first end of the flexible sheet is wrapped over the support frame, wherein the means for attaching each support leg to its associated handle further comprises a pair of swivel clamps comprising a first swivel clamp and a second swivel clamp, wherein each swivel clamp is used to attach a support leg to its associated handle.

2. A lawn chair with an incorporated solar light protective device according to claim 1 wherein the means for weighing down the flexible sheet further comprises (a) a length of pipe, (b) wherein the second end of the flexible sheet is wrapped around the length of pipe, (c) further wherein the sheet is wrapped over the head end of the lawn chair, (d) further wherein the pipe is placed hanging about one to two feet below the head end of the lawn chair.

3. A lawn chair with an incorporated solar light protective device according to claim 2 wherein the flexible sheet is fabricated from canvas.

4. A lawn chair with an incorporated solar light protective device comprising (a) a lawn chair, the lawn chair having two ends comprising a head end and a foot end, the lawn chair being fabricated from a hollow frame, the lawn chair further comprising two surfaces comprising an upper surface and a lower surface, the lawn chair further comprising two side surfaces comprising a first side surface and a second side surface, (b) means for providing flexibility on the lawn chair, said means further comprising (i) a plurality of flexible strips, (ii) wherein each of the flexible strips of the plurality of flexible strips are connected to the hollow frame, (c) means for supporting the lawn chair, said means further comprising (i) a foot stand attached to the lower surface of the lawn chair near the foot end of the lawn chair, (ii) a central support structure attached to the lawn chair approximately halfway in between the head end of the lawn chair and the foot end of the lawn chair, the central support structure further comprising (1) a pair of handles comprising a first handle and a second handle, (2) wherein the first handle is associated with the first side surface of the lawn chair, (3) further wherein the second handle is associated with the second side surface of the lawn chair, (d) a flexible sheet, the flexible sheet having two ends comprising a first end and a second end, the flexible sheet preferably being manufactured from canvas, and (e) means for mounting the flexible sheet to the lawn chair, said means further comprising a support frame, wherein the support frame further comprises (i) a pair of support legs comprising a first support leg and a second support leg, wherein the first support leg is associated with the first handle, further wherein the second support leg is associated with the second handle, (ii) a central support rod, wherein the central support rod connects the first support leg to the second support leg, (iii) means for attaching each support leg to its associated handle, said means further comprising (1) a pair of swivel clamps comprising a first swivel clamp and a second swivel clamp, (2) wherein each swivel clamp is used to attach a support leg to its associated handle, (iv) means for maintaining the flexible sheet in place over the top of the head end of the lawn chair, said means further comprising (1) a length of pipe, (2) wherein the second end of the flexible sheet is wrapped around the length of pipe, (3) further wherein the sheet is wrapped over the head end of the lawn chair, (4) further wherein the pipe is placed hanging about one to two feet below the head end of the lawn chair, (v) wherein the first end of the flexible sheet is wrapped over the support frame.

* * * * *